US009309789B2

(12) United States Patent
Hayashi

(10) Patent No.: US 9,309,789 B2
(45) Date of Patent: Apr. 12, 2016

(54) VALVE TIMING CONTROL APPARATUS

(75) Inventor: Masashi Hayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 290 days.

(21) Appl. No.: 13/173,309

(22) Filed: Jun. 30, 2011

(65) Prior Publication Data

US 2012/0048220 A1 Mar. 1, 2012

(30) Foreign Application Priority Data

Aug. 24, 2010 (JP) ..... 2010-187315

(51) Int. Cl.
*F01L 1/34* (2006.01)
*F01L 1/02* (2006.01)
*F01L 1/344* (2006.01)

(52) U.S. Cl.
CPC ..... *F01L 1/3442* (2013.01); *F01L 2001/34456* (2013.01); *F01L 2001/34469* (2013.01); *F01L 2800/01* (2013.01)

(58) Field of Classification Search
CPC ..... F01L 1/3442; F01L 2001/34483; F01L 1/34; F01L 1/022; F01L 2001/34453; F01L 2001/34469; F01L 1/34409; F01L 1/024; F01L 2001/34456; F01L 2800/01; F02D 2041/0001
USPC ..... 123/90.15, 90.17, 90.31
See application file for complete search history.

(56) References Cited

U.S. PATENT DOCUMENTS 6,330,870 B1 * 12/2001 Inoue et al. ..... 123/90.17
6,334,414 B1 * 1/2002 Okada et al. ..... 123/90.15
6,374,788 B1 4/2002 Fukuhara et al.
6,390,044 B2 * 5/2002 Yoshizawa et al. ..... 123/90.17
6,418,896 B2 7/2002 Ogawa
7,225,772 B2 6/2007 Mezger et al.
7,444,971 B2 * 11/2008 Suga et al. ..... 123/90.17
7,815,545 B2 10/2010 Nakashima et al.
2001/0039931 A1 * 11/2001 Ogawa ..... 123/90.17
2002/0166522 A1 11/2002 Takahashi et al.
2003/0196622 A1 10/2003 Wada et al.
2003/0200944 A1 10/2003 Takahashi et al.
2003/0217717 A1 * 11/2003 Pierik et al. ..... 123/90.17
2004/0055550 A1 * 3/2004 Smith ..... 123/90.17
2004/0112314 A1 * 6/2004 Kanada et al. ..... 123/90.17

(Continued)

FOREIGN PATENT DOCUMENTS

JP P2006-183631 A 7/2006

OTHER PUBLICATIONS

Japanese Office Action dated Jul. 3, 2012, issued in corresponding Japanese Application No. 2010-187315 with English translation.

(Continued)

*Primary Examiner* — Eric Keasel
*Assistant Examiner* — Daniel Wagnitz
(74) *Attorney, Agent, or Firm* — Nixon & Vanderhye P.C.

(57) ABSTRACT

A controller of a valve timing control apparatus executes an initial control and a normal control. The normal control causes a rotation phase of a vane rotor to be changed by controlling working fluid to flow into or out of operation chambers. The initial control causes working fluid to intermittently flow into a predetermined operation chamber of the operation chambers. The controller starts the initial control when an engine is activated. The controller switches the initial control into the normal control after the initial control is finished.

9 Claims, 8 Drawing Sheets

(56) References Cited

U.S. PATENT DOCUMENTS

2004/0255886 A1 12/2004 Mezger et al.
2005/0028772 A1* 2/2005 Komaki ..... 123/90.17

OTHER PUBLICATIONS

Office Action issued for Chinese Patent Application No. 201110249950.4, dated Jun. 26, 2013.

* cited by examiner

VALVE TIMING CONTROL APPARATUS

CROSS REFERENCE TO RELATED APPLICATION

This application is based on Japanese Patent Application No. 2010-187315 filed on Aug. 24, 2010, the disclosure of which is incorporated herein by reference in its entirety.

BACKGROUND OF THE INVENTION

1. Field of the Invention

The present invention relates to a valve timing control apparatus for controlling valve timing of a valve that is opened or closed by a camshaft through torque transmitted from a crankshaft in an internal combustion engine.

2. Description of Related Art

Conventionally, a fluid-drive valve timing control apparatus is known, and has a housing rotatable with a crankshaft and a vane rotor rotatable with a camshaft. A valve timing is controlled by working fluid supplied from a supply source, synchronized with a rotation of an engine. The control apparatus controls working fluid to flow in or out of operation chambers partitioned by vanes of the vane rotor in a rotating direction inside of the housing, thereby changing a rotation phase of the vane rotor relative to the housing.

JP-A-2003-314311 describes a fluid-drive valve timing control apparatus having a lock mechanism to lock the rotation phase, in which an unlock chamber communicating with a predetermined operation chamber is provided. If a pressure of working fluid flowing into the unlock chamber from the predetermined operation chamber is raised, the rotation phase is unlocked.

If a pressure of working fluid supplied from the supply source is low immediately after an engine is activated, the unlock of the rotation phase may become late. In this case, the rotation phase is restricted from having a smooth change in a normal control in which working fluid is controlled relative to each operation chamber. Therefore, the normal control is set to be allowed after the unlock of the rotation phase is detected in JP-A-2003-314311. However, the execution of the normal control becomes late because the detection of the unlock has to be waited. In this case, gas mileage and exhaust gas characteristics may become worse.

SUMMARY OF THE INVENTION

In view of the foregoing and other problems, it is an object of the present invention to provide a valve timing control apparatus.

According to an example of the present invention, a valve timing control apparatus for controlling valve timing of a valve that is opened or closed by a camshaft through torque transmitted from a crankshaft in an engine of a vehicle includes a housing, a vane rotor, a lock portion and a controller. The valve timing is controlled using working fluid supplied from a supply source in synchronization with a rotation of the engine. The housing is rotatable with the crankshaft. The vane rotor is rotatable with the camshaft, and has vanes partitioning an inside of the housing into plural operation chambers in a rotating direction. The vane rotor has a rotation phase with respect to the housing, and the rotation phase is changed by working fluid flowing into or out of the operation chambers. The lock portion locks or unlocks the rotation phase, and has an unlock chamber communicating with a predetermined operation chamber that is one of the operation chambers. The rotation phase is unlocked when a pressure of working fluid flowing into the unlock chamber from the predetermined operation chamber is raised. The controller performs an initial control and a normal control. The controller controls working fluid to intermittently flow into the predetermined operation chamber in the initial control. The controller controls the rotation phase to be changed by controlling working fluid to flow into or out of the operation chambers in the normal control. The controller starts the initial control when the engine is activated, and the controller switches the initial control into the normal control after the initial control is finished.

When the engine is activated, the initial control is performed in which working fluid intermittently flows into the predetermined chamber communicating with the unlock chamber of the lock portion, so that working fluid intermittently flows into the unlock chamber from the predetermined chamber. Therefore, while the rotation phase is locked by the lock portion, immediately after the engine is activated, the pressure of working fluid flowing into the unlock chamber can be raised without changing the rotation phase. The rotation phase is unlocked after the pressure of working fluid is raised in the initial control, and the initial control is quickly switched into the normal control. Accordingly, the valve timing control apparatus secures a predetermined performance of the engine.

The lock portion locks the rotation phase when a pressure of working fluid in the unlock chamber is lowered, and the controller performs a stop control in which working fluid is discharged from the predetermined operation chamber when the engine is stopped. Therefore, when the engine is stopped, the stop control is performed for discharging working fluid from the predetermined chamber, so that working fluid is discharged from the unlock chamber. As a result, the pressure of working fluid is lowered in the unlock chamber, so that the rotation phase is locked while the engine is stopped before being activated. However, the rotation phase is unlocked after the pressure of working fluid is raised in the unlock chamber, and the initial control is immediately switched into the normal control. Accordingly, the valve timing control apparatus secures a predetermined performance of the engine.

The vane rotor has a rotation center axis that intersects a vertical line of the vehicle located on a horizontal plane. The vane rotor stops together with the engine in a state that one of the operation chambers is located at an upper position. Working fluid is discharged from the upper-located chamber by gravity operation. Even when the predetermined chamber is located at the upper position, the rotation phase is unlocked after the pressure of working fluid is raised in the unlock chamber, and the initial control is immediately switched into the normal control. Accordingly, the valve timing control apparatus secures a predetermined performance of the engine.

The controller starts the normal control by controlling working fluid to flow into the predetermined operation chamber. At this time, the pressure of the predetermined chamber communicating with the unlock chamber is high, so that the rotation phase can be quickly changed so as to secure a predetermined performance of the engine.

The controller controls working fluid to intermittently flow into the predetermined operation chamber with a frequency that is lowered in accordance with a temperature lowering of working fluid, in the initial control. Because viscosity of working fluid is raised by the temperature lowering, a duration during which working fluid is made to flow into the predetermined chamber and the unlock chamber is extended in each cycle as the frequency is lowered. Therefore, the pressure of working fluid in the unlock chamber is raised even if the temperature of working fluid is low. Thus, the rotation phase is unlocked in the initial control, and the initial control is immediately switched into the normal control. Accordingly, the valve timing control apparatus secures a predetermined performance of the engine immediately after the engine is started.

The controller ends the initial control when a duration is elapsed, and the duration is extended in accordance with a temperature lowering of working fluid. The duration during which working fluid is made to intermittently flow into the predetermined chamber is extended as the temperature of working fluid is lowered, because viscosity of working fluid is raised by the temperature lowering. That is, before the normal control is performed, a sum of the time during which working fluid flows into the predetermined chamber and the unlock chamber is extended as the temperature of working fluid is lowered. Therefore, the pressure of working fluid in the unlock chamber is raised even if the temperature of working fluid is low. Thus, the rotation phase is unlocked in the initial control, and the initial control is immediately switched into the normal control. Accordingly, the valve timing control apparatus secures a predetermined performance of the engine.

One of the vanes partitions the predetermined operation chamber from an opposite operation chamber in a rotating direction of the vane rotor. The opposite operation chamber is one of the operation chambers. The predetermined operation chamber changes the rotation phase into a predetermined side between an advance side or a retard side. The opposite operation chamber changes the rotation phase into an opposite side opposite from the predetermined side. The controller alternately controls working fluid to flow into the predetermined operation chamber or the opposite operation chamber, in the initial control. Thus, the rotation phase is alternately changed between the predetermined side and the opposite side, so that a foreign object can be eliminated from an interface between the housing and the vane rotor. The rotation phase is unlocked after the pressure of working fluid is raised in the initial control, and the initial control is immediately switched into the normal control. Accordingly, the valve timing control apparatus secures a predetermined performance of the engine.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
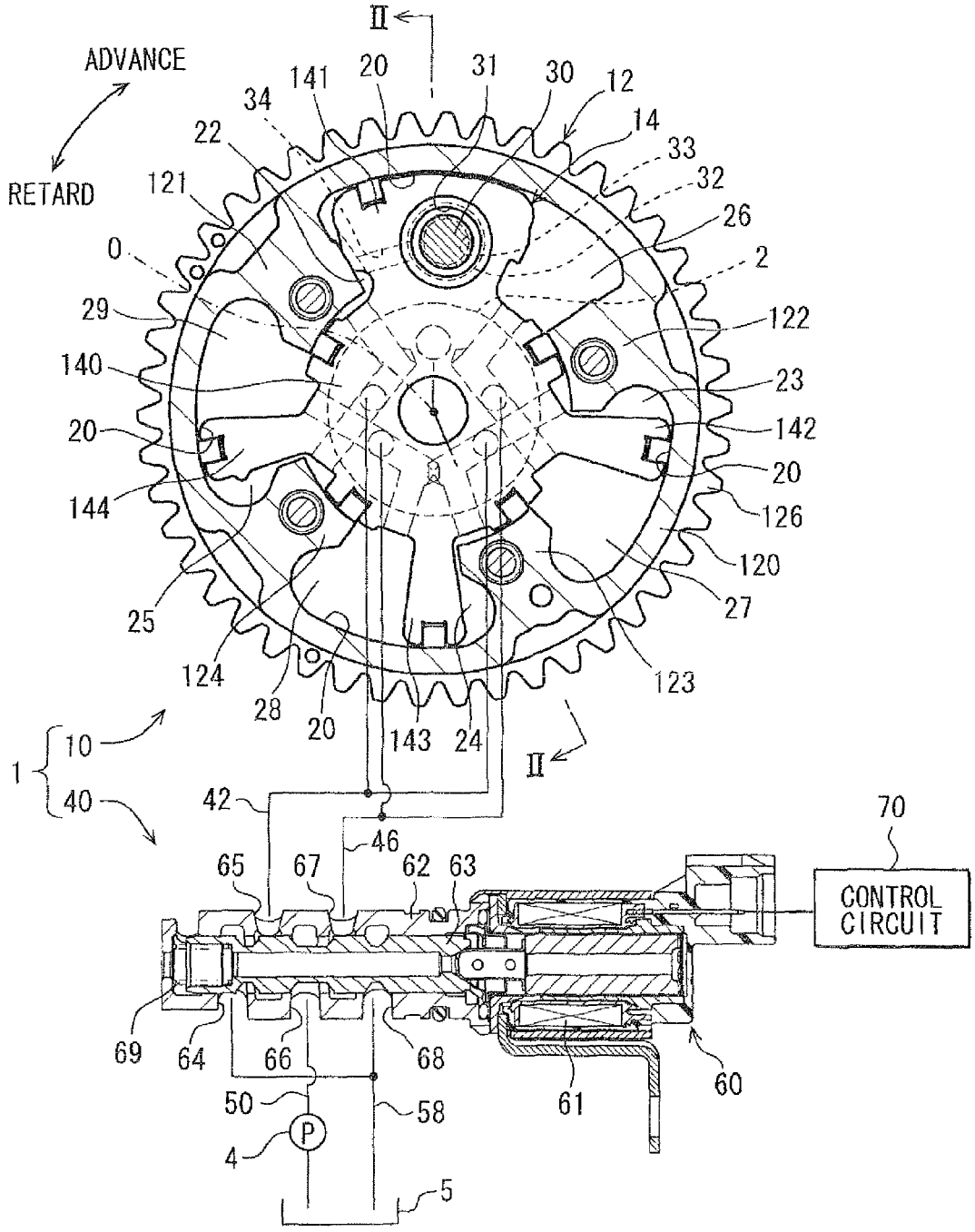
FIG. 1 is a schematic view illustrating a valve timing control apparatus according to a first embodiment.

A valve timing control apparatus 1 according to a first embodiment of the present invention is applied to an internal combustion engine of a vehicle, for example. The valve timing control apparatus 1 controls valve timing of an intake valve serving as a "valve" that is opened or closed by a camshaft 2 using working oil serving as "working fluid". As shown in FIG. 1, the valve timing control apparatus 1 has a driving unit 10 and a controller 40. The driving unit 10 is provided in a driving force transmission system to transmit a driving force of a crankshaft (not shown) of the internal combustion engine to the camshaft 2, and is driven with working oil. The controller 40 controls supply of working oil to the driving unit 10.

Driving Unit

The driving unit 10 has a housing 12 made of metal. The housing 12 has a cylindrical portion 120, and multiple shoes 121, 122, 123, 124 serving as partition members. The respective shoes 121, 122, 123, 124 are arranged in the cylindrical portion 120 at positions at approximately equal intervals in the rotation direction and project from the cylindrical portion 120 inwardly in a radial direction from above arranged positions. Each chamber 20 is respectively formed between the shoes 121, 122, 123, 124 located adjacent with each other in the rotation direction.

The housing 12 further has a sprocket 126 coaxially with the cylindrical portion 120, and plural teeth are arranged on the sprocket 126 in the rotation direction. The housing 12 is coupled to the crankshaft via a timing chain (not shown) engaged with the teeth of the sprocket 126. During running of the internal combustion engine, because the driving force is transmitted from the crankshaft to the sprocket 126, the housing 12 is rotated with the crankshaft in the clockwise direction in FIG. 1.

Figure 2:
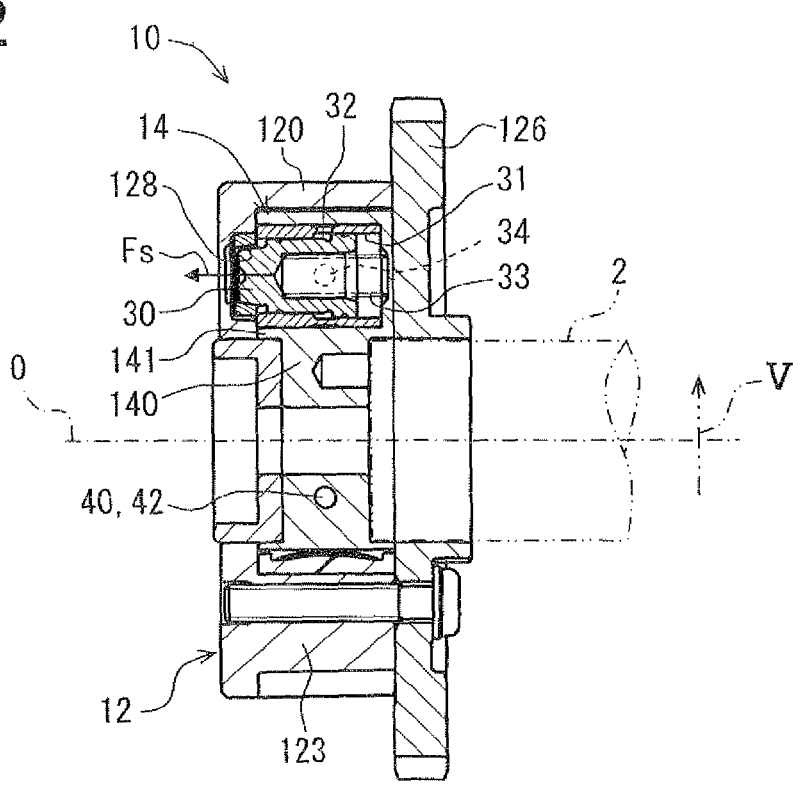
FIG. 2 is a cross-sectional view taken along line II-II of FIG. 1.

A vane rotor 14 made of metal is accommodated in the housing 12 coaxially with the housing 12, and has a rotation center axis O common with the housing 12. As shown in FIG. 2, the vane rotor 14 is arranged in a manner that the rotation center axis O intersects a vertical line V of the vehicle located on the horizontal plane by substantially 90°. The intersecting angle between the rotation center axis O and the vertical line V may be other than 90°.

The vane rotor 14 has a columnar rotation shaft 140 and vanes 141, 142, 143, 144. The shaft 140 is coaxially fixed to the camshaft 2. In this arrangement, the vane rotor 14 is rotated with the camshaft 2 in the clockwise direction in FIG. 1 and is relatively rotatable with respect to the housing 12. The respective vanes 141, 142, 143, 144 are arranged at positions of the shaft 140 at approximately equal intervals in the rotation direction and projected outward in the radial direction from the above positions. The vanes 141, 142, 143, 144 are accommodated in respectively corresponding chambers 20.

Each of the vanes 141, 142, 143, 144 defines an operation chamber 22, 23, 24, 25, 26, 27, 28, 29 in the housing 12 by partitioning the corresponding chamber 20 in the rotation direction. More particularly, an advance chamber 22 is formed between the shoe 121 and the vane 141; an advance chamber 23 is formed between the shoe 122 and the vane 142; an advance chamber 24 is formed between the shoe 123 and the vane 143; and an advance chamber 25 is formed between the shoe 124 and the vane 144. Further, a retard chamber 26 is formed between the shoe 122 and the vane 141; a retard chamber 27 is formed between the shoe 123 and the vane 142; a retard chamber 28 is formed between the shoe 124 and the vane 143; and a retard chamber 29 is formed between the shoe 121 and the vane 144.

The vane 141 has an accommodation hole 31 to reciprocably accommodate a column-shaped lock member 30 coaxially. An unlock chamber 32 is defined between the lock member 30 and the accommodation hole 31, and communicates with the advance chamber 22 through a communication hole 34 passing through the vane 141. Further, a lock spring 33 is interposed between the lock member 30 and the accommodation hole 31.

Figure 3:
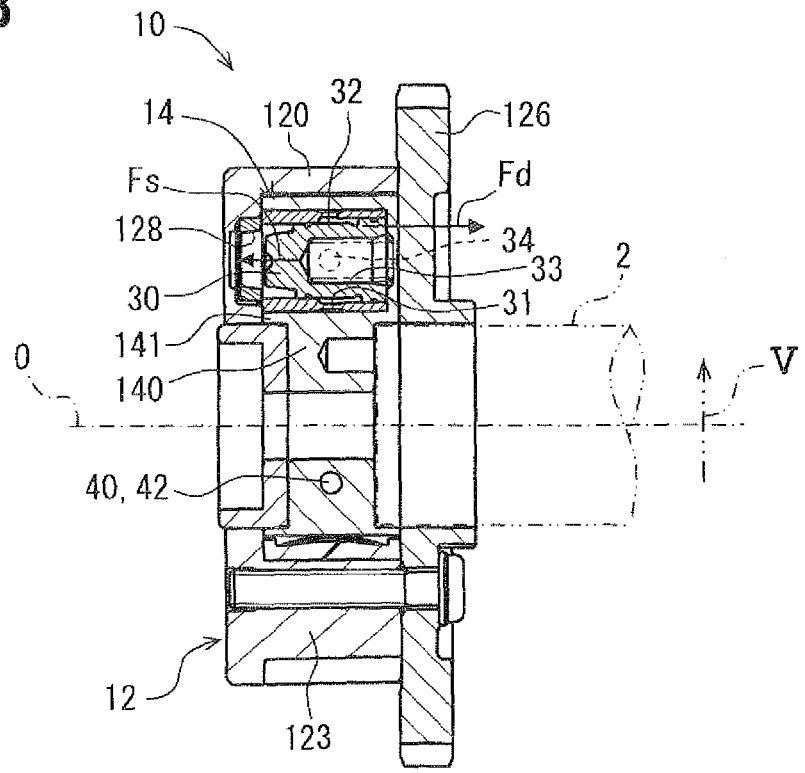
FIG. 3 is a cross-sectional view illustrating an operation state different from FIG. 2.

As shown in FIG. 2, the lock member 30 receives a biasing force Fs generated by the lock spring 33. As shown in FIG. 3, the lock member 30 receives a driving force Fd generated by a pressure of working oil flowing into the unlock chamber 32 from the advance chamber 22. The biasing force Fs and the driving force Fd are applied to the lock member 30 in directions opposite from each other.

If the pressure of working oil flowing into the unlock chamber 32 is lowered, the lock member 30 is pressed by the biasing force Fs, and as shown in FIG. 2, the lock member 30 is fitted with a fitting hole 128 of the housing 12. Thus, a rotation phase of the vane rotor 14 is locked with respect to the housing 12. For example, the rotation phase is locked at the most retard phase shown in FIG. 1.

If the pressure of working oil flowing into the unlock chamber 32 is raised, the lock member 30 is driven by the driving force Fd, and as shown in FIG. 3, the lock member 30 is separated from the fitting hole 128. Thus, the rotation phase of the vane rotor 14 is released from the lock state. An oil pressure for releasing the lock state, that produces the driving force Fd to separate the lock member 30 from the fitting hole 128 against the biasing force Fs, is set lower than an oil pressure necessary for rotating the vane rotor 14 relative to the housing 12 in an operation time of the engine.

Figure 4:
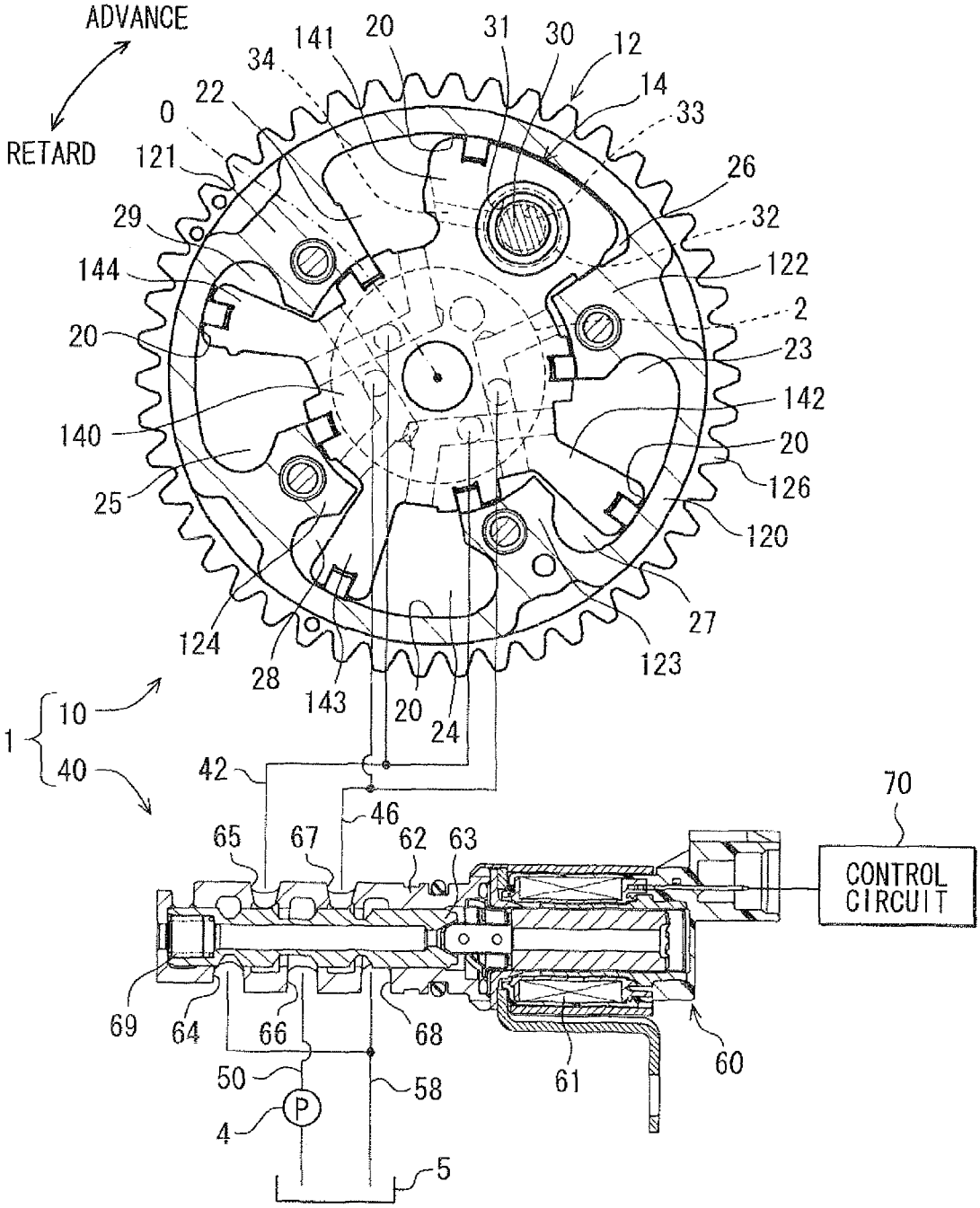
FIG. 4 is a schematic view illustrating the valve timing control apparatus having an operation state different from FIG. 1.

While the rotation phase is unlocked, working oil flows in or out of each operation chamber 22, 23, 24, 25, 26, 27, 28, 29, thereby changing the rotation phase so as to control the valve timing. Specifically, when working oil flows into the advance chamber 22, 23, 24, 25, and when working oil flows out of the retard chamber 26, 27, 28, 29, the rotation phase is changed toward the advance side, so that the valve timing is advanced. Therefore, as shown in FIG. 4, in a state that the retard chamber 26 is secured to have the minimum size, the vane 141 contacts the shoe 122 on the advance side in the rotation direction, thereby limiting the rotation phase to the most advance phase.

While the rotation phase is unlocked, when working oil flows into the retard chamber 26, 27, 28, 29, and when working oil flows out of the advance chamber 22, 23, 24, 25, the rotation phase is changed toward the retard side, so that the valve timing is retarded. Therefore, as shown in FIG. 1, in a state that the advance chamber 22 is secured to have the minimum size, the vane 141 contacts the shoe 121 on the retard side in the rotation direction, thereby limiting the rotation phase to the most retard phase.

While the rotation phase is unlocked, when working oil stays in each of the retard chamber 26, 27, 28, 29 and the advance chamber 22, 23, 24, 25, the rotation phase and the valve timing are maintained within a range influenced by a variation torque applied to the camshaft 2.

Controller

In the controller 40, as shown in FIGS. 1 and 2, an advance passage 42 is provided to pass through the camshaft 2 and the vane rotor 14, and communicates with the advance chambers 22, 23, 24, 25. Further, as shown in FIG. 1, a retard passage 46 is provided to pass through the camshaft 2 and the vane rotor 14, and communicates with the retard chambers 26, 27, 28, 29.

A supply passage 50 communicates with a discharge port of a pump 4. Working oil is pumped up with the pump 4 from an oil pan 5, and the pumped oil is supplied to the supply passage 50. The pump 4 may be a mechanical pump driven by a rotation of the crankshaft. Accordingly, during running of the internal combustion engine, working oil is continuously supplied to the supply passage 50. Therefore, the pressure of working oil supplied from the pump 4 is lowered as a rotation speed of the engine is made slower.

A drain passage 58 is provided in a manner that working oil is discharged to the oil pan 5. The oil pan 5 is placed under the driving unit 10 and a control valve 60 to be described later, and is released to outside air.

The control valve 60 is a solenoid valve which linearly and reciprocably drives a spool 63 in a sleeve 62 utilizing an electromagnetic driving force generated by a solenoid 61 and an elastic biasing force generated by a return spring 69. The control valve 60 has an advance drain port 64, an advance communication port 65, a supply port 66, a retard communication port 67 and a retard drain port 68 in this order from an end to the other end in the axis direction.

The drain port 64, 68 communicates with the drain passage 58. The communication port 65 communicates with the advance passage 42, and the communication port 67 communicates with the retard passage 46. The supply port 66 communicates with the supply passage 50. Connection states among the ports 64, 65, 66, 67, 68 are switched when a driving position of the spool 63 is changed by electricity supplied to the solenoid 61.

A control circuit 70 is an electronic circuit having a microcomputer, for example, and is electrically connected to the solenoid 61 of the control valve 60 and electric components (not shown) of the engine. The control circuit 70 controls energization of the solenoid 61 and the running of the internal combustion engine based on a program memorized in an internal memory.

In the controller 40, the spool 63 is moved when the control circuit 70 controls the solenoid 61 to be supplied with electricity, thereby controlling flow of working oil with respect to the chambers 22, 23, 24, 25, 26, 27, 28, 29.

More specifically, as shown in FIG. 4, when the spool 63 is driven to an advance position, the ports 66, 65 are connected with each other, and the ports 68, 67 are connected with each other, so that working oil supplied from the pump 4 flows into the advance chambers 22, 23, 24, 25. Further, working oil is discharged into the drain pan 5 from the retard chambers 26, 27, 28, 29. Thus, the rotation phase is changed into the advance side, and the valve timing is advanced.

In contrast, as shown in FIG. 1, when the spool 63 is driven to a retard position, the ports 65, 64 are connected with each other, and the ports 66, 67 are connected with each other, so that working oil supplied from the pump 4 flows into the retard chambers 26, 27, 28, 29. Further, working oil is discharged into the drain pan 5 from the advance chambers 22, 23, 24, 25. Thus, the rotation phase is changed into the retard side, and the valve timing is retarded.

Further, when the spool 63 is driven to a holding position (not shown), the ports 65, 67 are mutually disconnected, and both of the ports 65, 67 are disconnected with respect to the ports 64, 66, 68. Working oil is stored in both of the retard chambers 26, 27, 28, 29 and the advance chambers 22, 23, 24, 25. Thus, the rotation phase and the valve timing are maintained within a range influenced by the variation torque.

Control Flow

Figure 5:
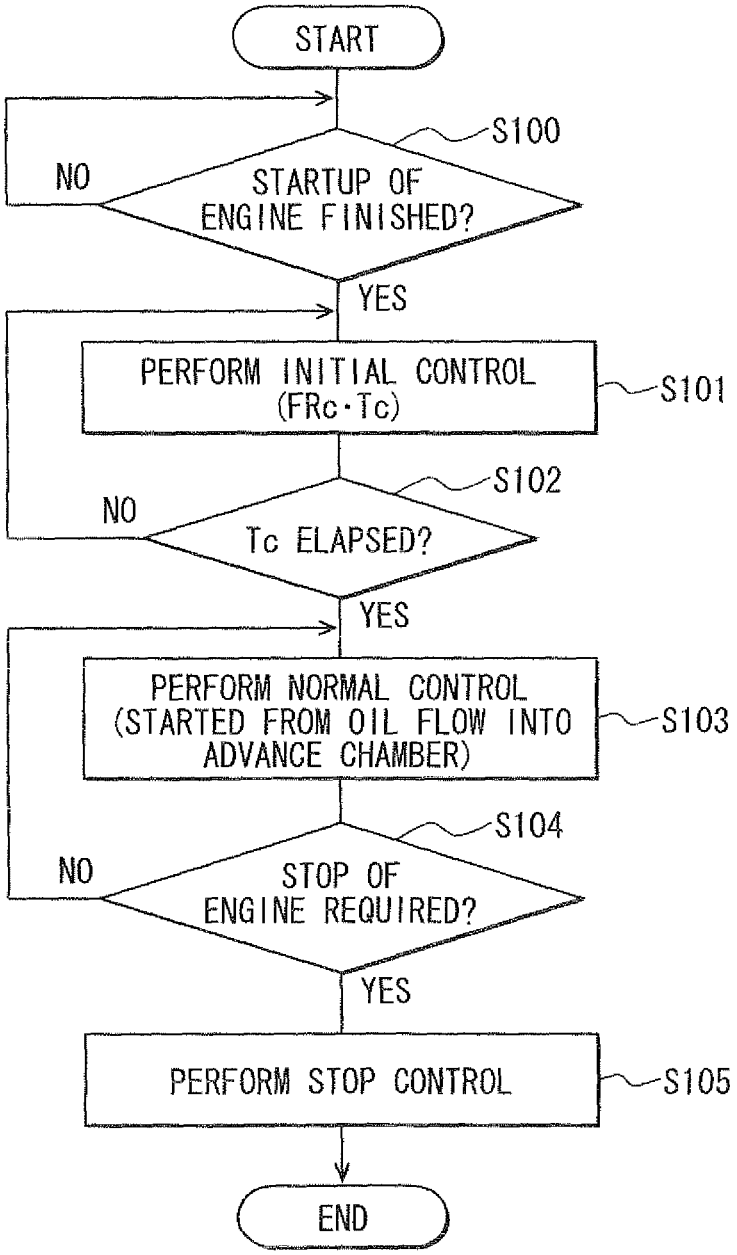
FIG. 5 is a flow chart illustrating a control flow performed by a control circuit of the valve timing control apparatus.

A flow of control performed by the control circuit 70 is described with reference to FIG. 5. The control flow is started when the engine is cranked in response to an activation requirement, for example, turning on an engine switch of the vehicle. Further, while the engine is stopped and while a startup of the engine is performed before the control flow is started, the spool 63 is driven to the retard position by stopping electricity supply for the solenoid 61, so that the rotation phase is locked at the most retard phase.

In S100 of the control flow, it is determined whether the startup of the engine is finished based on a complete explosion of the cranked engine. If the engine is activated, an initial control is performed in S101. In the initial control, working oil is intermittently made to flow into the advance chamber 22 communicating with the unlock chamber 32 with a constant frequency FRc during a predetermined duration Tc. Specifically, the spool 63 is alternately and repeatedly driven to the advance position and the retard position by controlling the energization for the solenoid 61. That is, working oil is alternately and repeatedly made to flow into the advance chamber 22, 23, 24, 25 and the retard chamber 26, 27, 28, 29.

The frequency FRc is set to be about 300 Hz in advance in a manner that the pressure in the advance chamber 22 can be raised even if a viscosity of working oil is raised by a temperature lowering. Further, the duration Tc in the initial control is set as about one second in advance in a manner that the pressure of working oil can be raised, similarly to the frequency FRc. Therefore, when the duration Tc is elapsed, the lock member 30 is separated from the fitting hole 128 in accordance with the pressure raising of working oil flowing into the unlock chamber 32 from the advance chamber 22, so that the rotation phase is unlocked.

If it is determined that the duration Tc is elapsed after the initial control is started at S102, a normal control is performed at S103. In the normal control, working oil is controlled to flow in or out of the chambers 22, 23, 24, 25, 26, 27, 28, 29 by the energization of the solenoid 61, so as to realize the valve timing that optimizes the engine performance such as gas mileage or exhaust gas characteristics. For example, when the normal control is started, the spool 63 is driven to the advance position, thereby starting a control that causes working oil to flow into the advance chamber 22 communicating with the unlock chamber 32 and the other advance chambers 23, 24, 25.

If it is determined that a stop of the engine is required at S104, for example, through turning off the engine switch, a stop control is performed at S105. In the stop control, the spool 63 is driven to the retard position by stopping the energization of the solenoid 61. The advance chamber 22 communicating with the unlock chamber 32 and the other advance chambers 23, 24, 25 communicate with the drain pan 5, and the retard chambers 26, 27, 28, 29 communicate with the pump 4. Therefore, while the engine has an inertial rotation in which the fuel injection is stopped, working oil is discharged from the advance chambers 23, 24, 25 and the unlock chamber 32, and flows into the retard chambers 26, 27, 28, 29. Thus, when the engine is completely stopped, the rotation phase is locked at the most retard phase that minimizes the advance chamber 22, and the control flow is ended.

The stop control is performed when the engine is stopped, thereby discharging working oil from the advance chamber 22 and the unlock chamber 32. Because the rotation center axis O of the vane rotor 14 intersects the vertical line V, one of the chambers 22, 23, 24, 25, 26, 27, 28, 29 partitioned in the rotating direction centering at the axis O is stopped at an upper position when the engine is stopped. Therefore, discharge of working oil is especially promoted by gravity action from the advance chamber 22 stopped at the upper position. Thus, while the engine is stopped, the pressure of working oil in the advance chamber 22 is easily lowered to an atmospheric level.

Further, while the engine is started thereafter, a pressure of working oil supplied from the pump 4 is low, so that the supplied oil only flows into the advance chamber 22 through a clearance between the sleeve 62 and the spool 63. In this case, at a timing when the startup of the engine is finished, the oil pressure in the advance chamber 22 may be difficult to reach an unlock pressure necessary for the unlocking that causes the lock member 30 to fit with the fitting hole 128.

However, according to the first embodiment, because the initial control is performed when the engine is started, working oil intermittently flows into the advance chamber 22 and the unlock chamber 32. Therefore, immediately after the engine is started, while the rotation phase is locked, the pressure of working oil flowing into the unlock chamber 32 can be securely raised without changing the rotation phase. After the initial control in which the pressure of oil flowing into the unlock chamber 32 is raised, the rotation phase is unlocked. Then, the initial control is quickly switched into the normal control, so that the rotation phase is changed by controlling working fluid flowing into or out of the chambers 22, 23, 24, 25, 26, 27, 28, 29.

In the initial control, the rotation phase is alternately changed between the advance side and the retard side by the flow of working oil into the advance chambers 22, 23, 24, 25 or the retard chambers 26, 27, 28, 29. Therefore, not only working oil intermittently flows into the advance chamber 22, but also a foreign object can be eliminated from an interface between the housing 12 and the rotor 14 which are relatively rotatable. Thus, after the initial control, the initial control is immediately switched into the normal control, so that the rotation phase defined between the housing 12 and the rotor 14 can be securely changed. Further, the normal control is started by making working oil to flow into the advance chamber 22. Therefore, the rotation phase can be immediately changed to the advance side because the pressure of oil in the advance chamber 22 communicating with the unlock chamber 32 is high enough at the timing when the normal control is started.

According to the first embodiment, the controlling of the valve timing is started in a short time immediately after the engine is activated so as to optimize the engine performance such as gas mileage or exhaust gas characteristics.

The unlock chamber 32 defined by the accommodation hole 31 and the lock member 30, the lock spring 33 and the fitting hole 128 may construct a lock portion. The control circuit 70 may correspond to a controller. The advance chamber 22 may correspond to a predetermined operation chamber. The retard chamber 26 may correspond to an opposite operation chamber opposite from the predetermined operation chamber.

Second Embodiment

Figure 6:
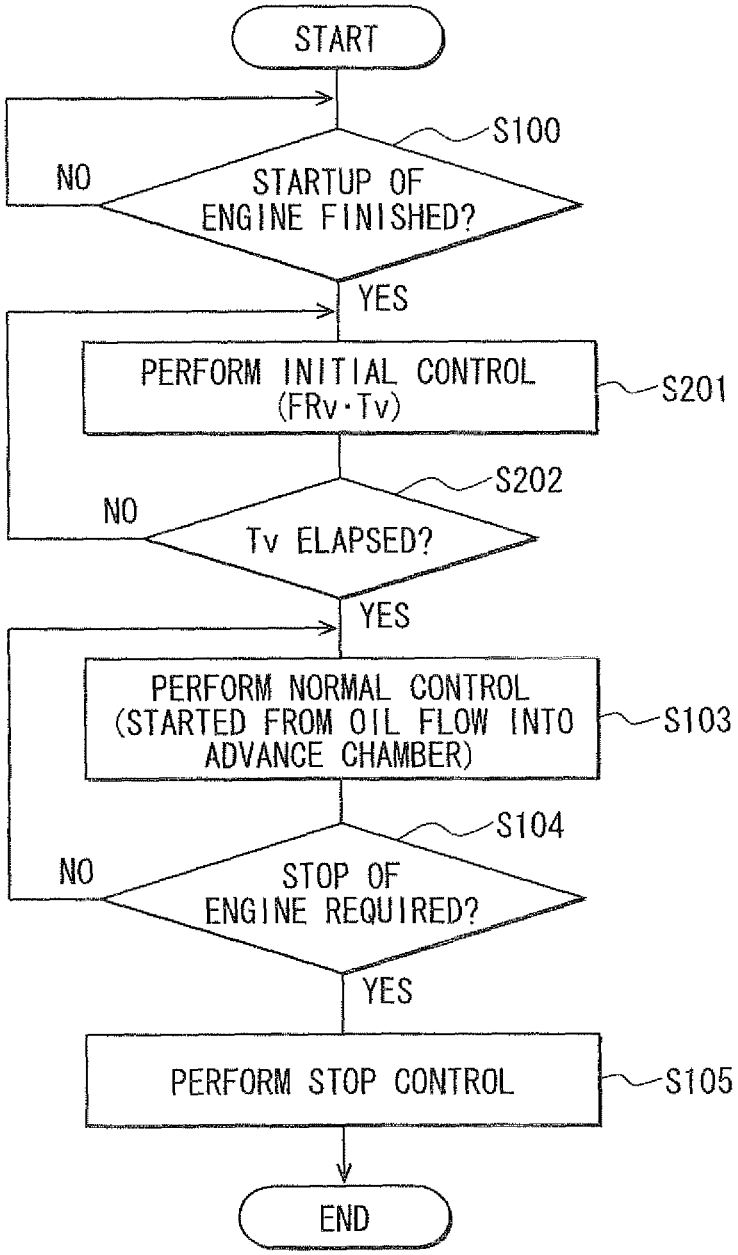
FIG. 6 is a flow chart illustrating a control flow performed by a control circuit of a valve timing control apparatus according to a second embodiment.
Figure 7:
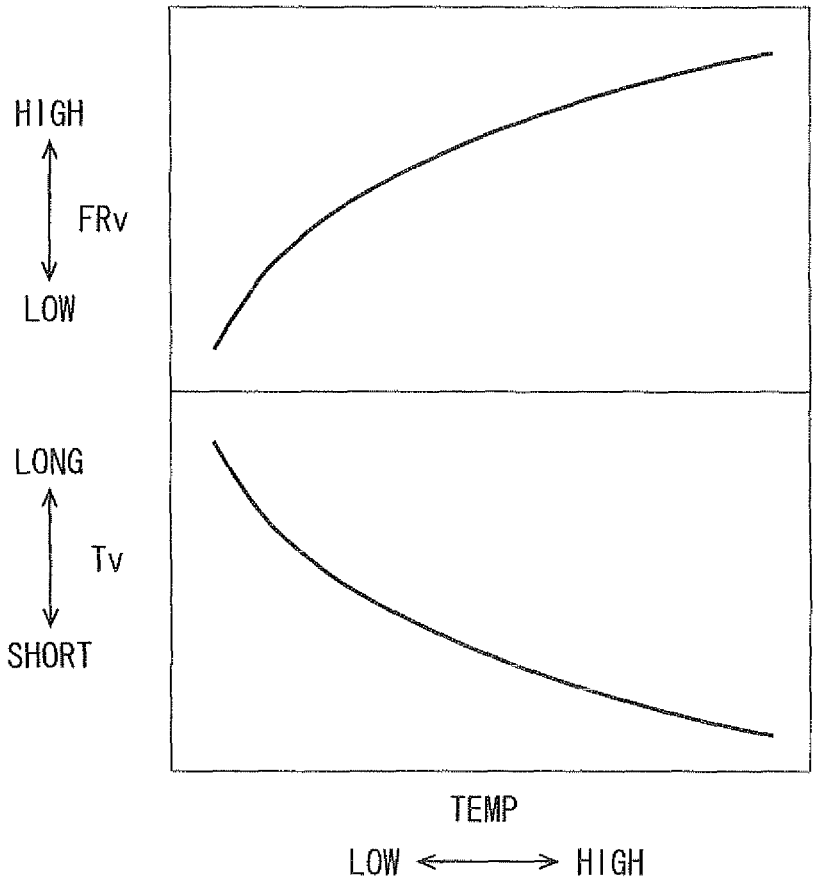
FIG. 7 is a characteristic view illustrating S201 of FIG. 6.

As shown in FIG. 6, the first embodiment is modified in a second embodiment. The initial control corresponding to S101 of the first embodiment is changed into an initial control corresponding to S201 of the second embodiment. In S201, as shown in FIG. 7, for example, working oil is intermittently made to flow into the advance chamber 22 communicating with the unlock chamber 32 with a frequency FRv and a duration Tv which are variable in accordance with a temperature TEMP of working oil.

Specifically, the frequency FRv is variably set to gradually decrease in accordance with a lowering of the temperature TEMP at a time of starting S201. Further, the duration Tv of the initial control is variably set to be gradually extended in accordance with a lowering of the temperature TEMP at a time of starting S201. The frequency FRv and the duration Tv are variably set based on the temperature TEMP of working oil. The temperature TEMP is indirectly estimated based on a temperature of cooling water for engine obtained from a signal output from a water temperature sensor of the vehicle. Alternatively, the temperature TEMP may be directly measured using an oil temperature sensor.

Working oil is intermittently made to flow into the advance chamber 22 when working oil alternately and repeatedly flows into the advance chambers 22, 23, 24, 25 or the retard chambers 26, 27, 28, 29 with the frequency FRv and the duration Tv, similarly to the first embodiment. At S202 subsequent to S201, it is determined whether the duration Tv is elapsed.

According to the second embodiment, the duration during which working oil is made to flow into the chamber 22, 32 is extended in accordance with a lowering of the temperature TEMP as the frequency FRv is lowered, in each cycle in which working fluid intermittently flows with the frequency FRv. Working oil becomes difficult to flow into the chamber 22, 32 if the temperature TEMP is lowered because a viscosity of working oil is raised. Even in this situation, because the duration during which working oil flows into the unlock chamber 32 is extended in each cycle, the pressure of working oil in the unlock chamber 32 can be securely raised.

Further, in the second embodiment, before the initial control is switched into the normal control, a sum of the durations during which working oil flows into the chambers 22, 32 is extended in accordance with the lowering in the temperature TEMP, so that the pressure of working oil in the chamber 32 can be more securely raised. Thus, in the initial control immediately after the engine is activated, the rotation phase is securely unlocked by the raising of the pressure of working oil in the unlock chamber 32. Further, the initial control is quickly switched into the normal control, thereby securing the engine performance.

Third Embodiment

Figure 8:
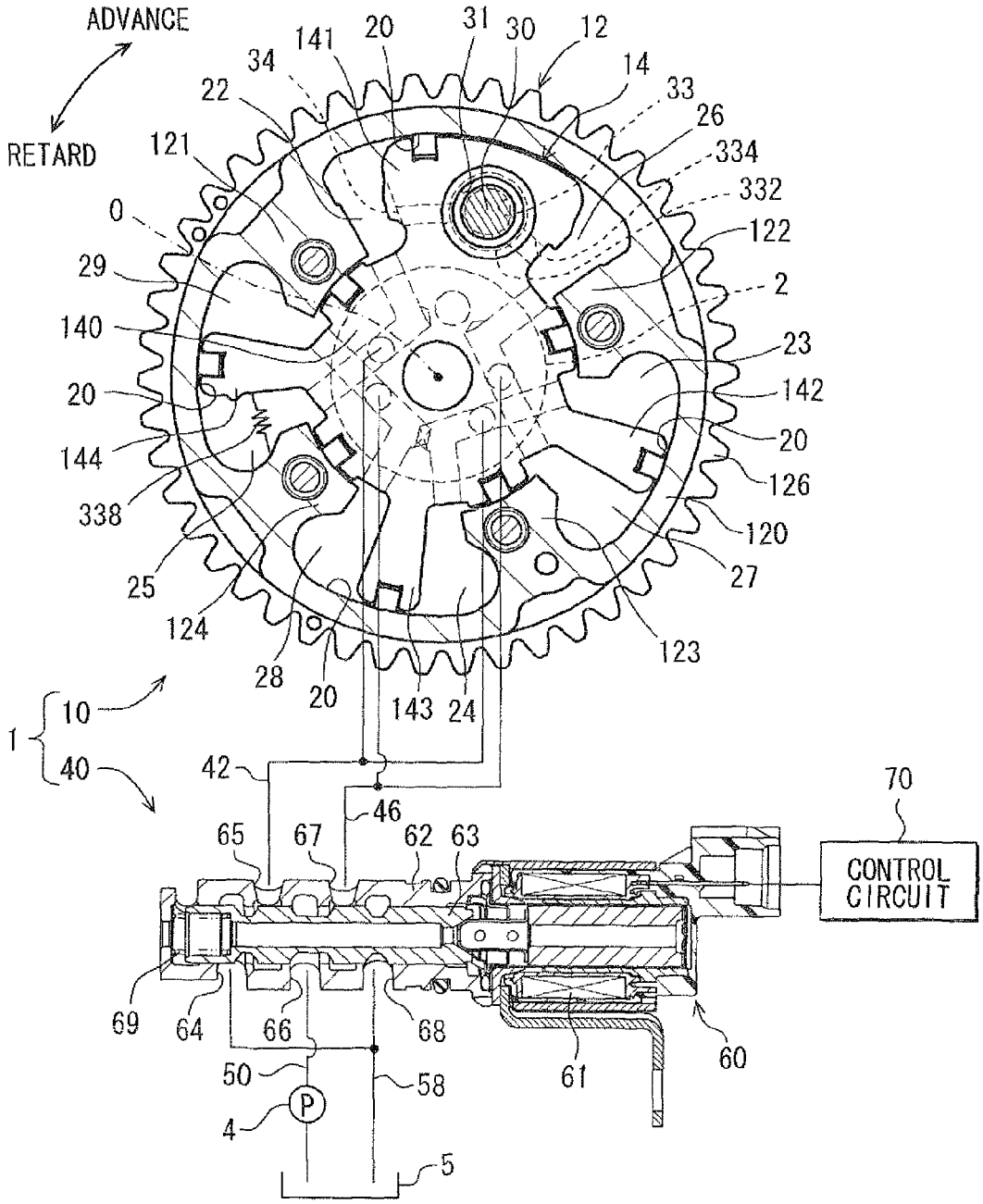
FIG. 8 is a schematic view illustrating a valve timing control apparatus according to a third embodiment.

As shown in FIG. 8, the first embodiment is modified in a third embodiment. In the third embodiment, an unlock chamber 332 is defined between a lock member 30 and an accommodation hole 31. The unlock chamber 332 communicates with an advance chamber 22 through an advance communication hole 34, and communicates with a retard chamber 26 through a retard communication hole 334.

Further, a middle phase of FIG. 8 defined between the most retard phase and the most advance phase is set as a lock phase where the rotation phase is locked while a lock phase of the first embodiment corresponds to the most retard phase. When the lock member 30 is fitted with the fitting hole 128 at the lock phase, the rotation phase is locked. As shown in FIG. 8, an assist spring 338 biases the vane rotor 14 toward the advance side with respect to the housing 12, between the most retard phase and the lock phase. Therefore, the rotation phase can be easily changed into the lock phase when the engine is stopped.

Figure 9:
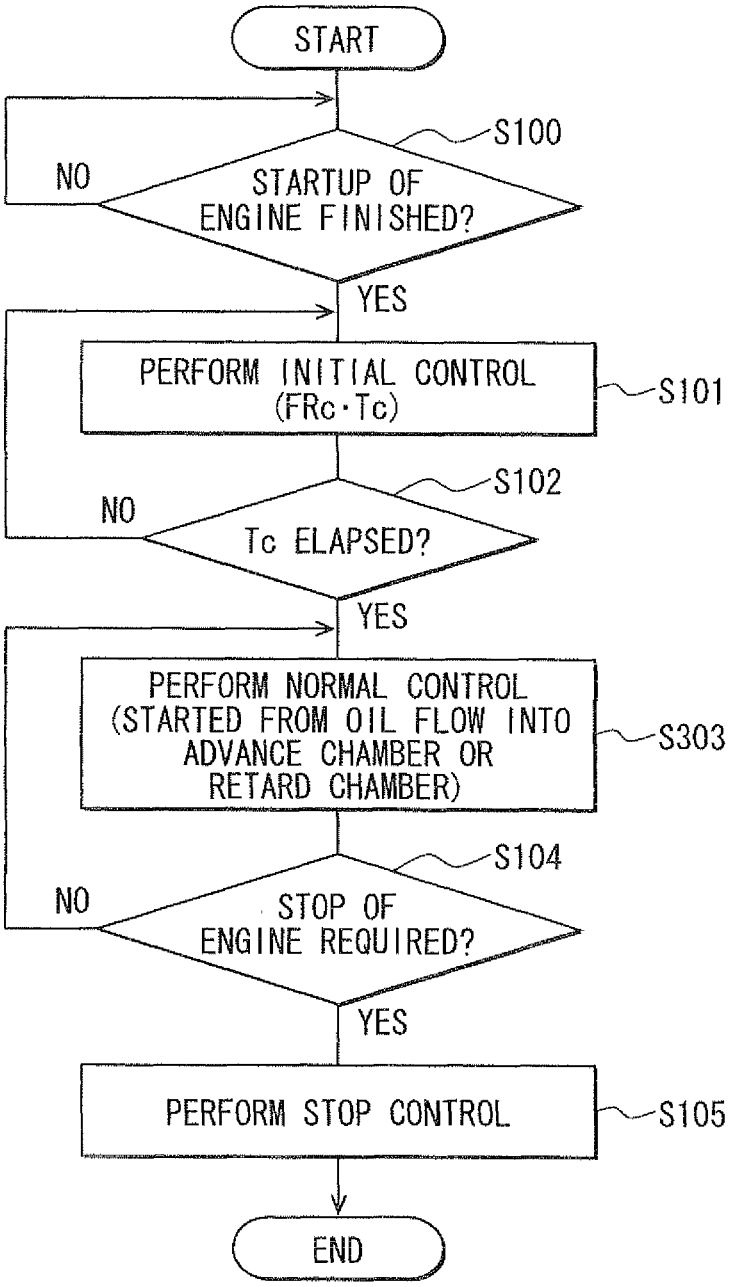
FIG. 9 is a flow chart illustrating a control flow performed by a control circuit of the valve timing control apparatus of the third embodiment.

As shown in FIG. 9, the normal control corresponding to S103 of the first embodiment is changed into a normal control corresponding to S303 of the third embodiment. When the normal control is started, the rotation phase is selected to be changed into the advance side or the retard side, and the spool 63 is driven by the energization of the solenoid 61 so as to change the rotation phase into the advance position or the retard position. If the advance side is selected, the normal control is started by making working oil to flow into the advance chambers 22, 23, 24, 25. If the retard side is selected, the normal control is started by making working oil to flow into the retard chambers 26, 27, 28, 29. The changing direction of the rotation phase is suitably selected based on environmental temperature or state of the engine.

In the third embodiment, an initial control is executed similarly to the first embodiment, so that working oil alternately flows into the advance chamber 22, 23, 24, 25 or the retard chamber 26, 27, 28, 29. Therefore, oil flow into the advance chamber 22 communicating with the unlock chamber 332 and oil flow into the retard chamber 26 communicating with the unlock chamber 332 are intermittently continued with a time lag (deviation) of half cycle from each other.

Thus, under the situation where the rotation phase is locked immediately after the engine is started, the pressure of working oil flowing into the unlock chamber 332 is securely raised within a pressure range without changing the rotation phase by oil flowing into the chamber 22, 26. Further, similarly to the first embodiment, the rotation phase is alternately changed into the advance side or the retard side, so that a foreign object can be eliminated from an interface defined between the housing 12 and the vane rotor 14.

The rotation phase is unlocked when the pressure of working oil flowing into the unlock chamber 332 is raised in the initial control. Then, the rotation phase defined between the housing 12 and the vane rotor 14 is changed by immediately switching the initial control into the normal control. Further, at the time of starting the normal control, the pressure of working oil in the chamber 22, 26 communicating with the unlock chamber 332 is sufficiently raised. Therefore, the rotation phase can be quickly changed from any side between the advance side or the retard side. Accordingly, a predetermined engine performance can be secured.

The unlock chamber 332 defined by the accommodation hole 31 and the lock member 30, the lock spring 33 and the fitting hole 128 may construct a lock portion. Each of the advance chamber 22 and the retard chamber 26 may correspond to a predetermined operation chamber. When the advance chamber 22 corresponds to the predetermined operation chamber, the retard chamber 26 may correspond to an opposite operation chamber opposite from the predetermined operation chamber. When the retard chamber 26 corresponds to the predetermined operation chamber, the advance chamber 22 may correspond to an opposite operation chamber opposite from the predetermined operation chamber.

Other Embodiments

The present invention is not limited to the above embodiments. Changes and modifications are to be understood as being within the scope of the present invention as defined by the appended claims.

For example, in the initial control S101, S201 of the first and second embodiments, working oil may be intermittently made to flow into the advance chamber 22 by repeating the driving of the spool 63 alternately between the advance position and the holding position.

In the initial control S201 of the second embodiment, the variable frequency FRv may be changed into the constant frequency FRc of the first embodiment, while the duration Tv is set variable. Alternatively, the variable duration Tv may be changed into the constant duration Tc of the first embodiment, while the frequency FRv is set variable.

In the third embodiment, the initial control S101 may be changed with the initial control S201 of the second embodiment.

Further, a relationship between the advance side/phase/position and the retard side/phase/position can be made opposite from the above description. Furthermore, the present invention may be applied to an exhaust valve other than the intake valve, or may be used for both of the intake valve and the exhaust valve.

Such changes and modifications are to be understood as being within the scope of the present invention as defined by the appended claims.

What is claimed is:

1. A valve timing control apparatus for controlling valve timing of a valve that is opened or closed by a camshaft through torque transmitted from a crankshaft in an engine of a vehicle, the valve timing being controlled using a working fluid supplied from a supply source in synchronization with a rotation of the engine, the valve timing control apparatus comprising:

a housing that is rotatable with the crankshaft;

a vane rotor that is rotatable with the camshaft, the vane rotor having vanes partitioning an inside of the housing into plural operation chambers in a rotating direction, the vane rotor having a rotation phase with respect to the housing, the rotation phase being changed by working fluid flowing into or out of the operation chambers;

a lock portion to lock or unlock the rotation phase, the lock portion having an unlock chamber communicating with a predetermined operation chamber that is one of the operation chambers, the rotation phase being unlocked when a pressure of the working fluid flowing into the unlock chamber from the predetermined operation chamber is raised;

a controller including a control valve having a spool; and the controller configured to perform an initial control and a normal control, the controller controlling working fluid to intermittently flow into the predetermined operation chamber in the initial control, the controller controlling the rotation phase to be changed by controlling working fluid to flow into or out of the operation chambers in the normal control, wherein the controller executes the initial control in a state where the rotation phase is locked by the lock portion, and the rotation phase is unlocked by the lock portion when the initial control is completed, the controller drives the spool to an advance position such that working fluid supplied from a supply source flows into the predetermined operation chamber and that working fluid is discharged from an opposite operation chamber opposite from the predetermined operation chamber, the controller drives the spool to a retard position such that working fluid supplied from the supply source flows into the opposite operation chamber and that working fluid is discharged from the predetermined operation chamber, the controller alternately and repeatedly drives the spool between the advance position and the retard position in the initial control, the controller starts the initial control immediately after the engine is activated, and the controller switches the initial control into the normal control after the initial control is finished.

2. The valve timing control apparatus according to claim 1, wherein the lock portion locks the rotation phase when a pressure of working fluid in the unlock chamber is lowered, and the controller performs a stop control in which working fluid is discharged from the predetermined operation chamber when the engine is stopped.

3. The valve timing control apparatus according to claim 2, wherein the vane rotor has a rotation center axis that is substantially parallel to a horizontal plane.

4. The valve timing control apparatus according to claim 2, wherein the controller starts the normal control by controlling working fluid to flow into the predetermined operation chamber.

5. The valve timing control apparatus according to claim 1, wherein the controller ends the initial control when a duration is elapsed, and the duration is extended in accordance with a temperature lowering of working fluid.

6. The valve timing control apparatus according to claim 1, wherein one of the vanes partitions the predetermined operation chamber from an opposite operation chamber in a rotating direction of the vane rotor, the opposite operation chamber being one of the operation chambers, the rotation phase is changed into a predetermined side between an advance side or a retard side by the predetermined operation chamber, the rotation phase is changed into an opposite side opposite from the predetermined side by the opposite operation chamber, and the controller alternately and repeatedly controls working fluid to flow into the predetermined operation chamber or the opposite operation chamber, in the initial control.

7. The valve timing control apparatus according to claim 1, wherein the controller controls working fluid to intermittently flow into the predetermined operation chamber with a frequency that is lowered in accordance with a temperature lowering of working fluid, in the initial control.

8. The valve timing control apparatus according to claim 1, wherein the predetermined operation chamber corresponds to an advance chamber, the opposite operation chamber corresponds to a retard chamber, and the lock portion locks the rotation phase at a most retard phase.

9. The valve timing control apparatus according to claim 1, wherein the controller controls working fluid to intermittently flow into the unlock chamber, in the initial control, to raise a pressure of the working fluid in the unlock chamber.

* * * * *